US005482255A

United States Patent [19]

Daschel et al.

[11] Patent Number: 5,482,255

[45] Date of Patent: Jan. 9, 1996

[54] WINCH HAVING HEAT DISSIPATING BRAKING

[75] Inventors: Matthew D. Daschel, Milwaukie; Thomas M. Telford, Gladstone, both of Oreg.

[73] Assignee: Warn Industries, Inc., Milwaukie, Oreg.

[21] Appl. No.: 236,637

[22] Filed: May 2, 1994

[51] Int. Cl.[6] ..... B66D 5/14

[52] U.S. Cl. ..... 254/378

[58] Field of Search ..... 254/344, 375, 254/378

[56] References Cited

U.S. PATENT DOCUMENTS

| | | | |
|---|---|---|---|
| 2,827,136 | 3/1958 | Sorchy | 192/7 |
| 2,834,443 | 5/1958 | Olchawa | 192/8 R |
| 3,536,169 | 10/1970 | Arnold . | |
| 4,461,460 | 7/1984 | Telford | 254/344 |
| 4,545,567 | 10/1985 | Telford et al. | 254/378 X |
| 4,565,352 | 1/1986 | Hasselman et al. | 254/344 |
| 4,601,370 | 7/1986 | Papadopoulos | 254/378 X |
| 5,261,646 | 11/1993 | Telford | 254/375 |

*Primary Examiner*—Daniel P. Stodola
*Assistant Examiner*—Emmanuel M. Marcelo
*Attorney, Agent, or Firm*—Klarquist, Sparkman, Campbell, Leigh & Whinston

[57] ABSTRACT

A winch wherein braking is achieved by cam actuation, the cam actuation, in a static condition, frictionally interlocking the drive shaft to the cable drum. A gear reduction mechanism is provided between the shaft and drum and is prevented by such interlocking from producing differential rotation of the drum and thus affects lockup or braking of the drum. The locking mechanism is optimally provided by a stator that is fixed to the drum, the stator providing brake surfaces for the drum having disc brake-like braking action. The stator conducts heat from the end surface thereof to the drum and thus to the atmosphere.

6 Claims, 2 Drawing Sheets

WINCH HAVING HEAT DISSIPATING BRAKING

FIELD OF THE INVENTION

This invention relates to a braking mechanism for a winch wherein heat generated by braking during load induced unwinding is more readily dissipated.

BACKGROUND OF THE INVENTION

The present invention is directed to the same subject as disclosed in U.S. Pat. No. 5,261,646, issued Nov. 16, 1993. As disclosed in the '646 patent, a major concern for winches occurs during the process of letting out the winch cable when under a load. The motors typically used for winding cable onto the drum are not sufficient to brake the cable drum. Thus, a supplemental braking mechanism is used. Such braking mechanisms are typically capable of securing the drum against unwinding but not for controlled unwinding. A situation might occur, for example, where a vehicle is being lowered down a steep hill. The braking mechanism has to allow unwinding of the cable drum but at a slowed pace as compared to free fall.

The '646 patent discloses a mechanism whereby a cam mechanism operates to apply braking force when the motor's drive shaft is non-rotating. The linkage between the drive shaft assembly and cam mechanism is such that the braking force is released by the drive shaft when rotated in either direction. With the drive shaft rotating to unwind the cable and with the cable under load, the brake is released until the forced unwinding by the load outruns the drive shaft rotation at which point the brake is re-applied. The drive shaft then catches up and again causes brake release and the process is repeated. The brake mechanism includes a dampening action that permits sharp starts and stops to create a somewhat steady but controlled braking that produces the effect of a constant unwinding at the rate of the rotating drive shaft.

The '646 patent has common ownership with the present invention. The '646 patent, including the full disclosure of the drawings, description and claims, is incorporated herein by reference.

BRIEF DESCRIPTION OF THE INVENTION

A problem that is encountered with the brake mechanism as generally explained above is the need for increased dissipation of heat generated by the braking action. It is desirable to conduct the heat to an exterior surface which is cooled by ambient air. The '646 patent attempts to effect braking in a manner that allows for heat conduction to the cable drum, the exterior of which is exposed to ambient air. The brake mechanism of the '646 patent includes conical braking shoes that convert axial movement to radial movement whereby the axially directed cam action causes radially directed brake pads to press against the drum's cylindrical inner surface whereat the braking action occurs. However, experience has shown that considerable friction and thus heat generation is also created between the conical braking shoes and the radial brake pads. The brake pads are heat insulators and thus the heat created between the shoes and pads is retained within the mechanism. Under severe loads this can be a problem and an objective herein is to facilitate heat dissipation with an improved design over that of the '646 disclosed embodiment.

The modification basically includes a cylindrical stator which is fixed within the drum. The stator is produced from heat conductive metal and is in tight surface-to-surface fixed contact with the inner surface of the drum. The drive shaft assembly extends through the center opening in the stator. The cylindrical end faces of the stator define the braking surfaces. Brake pads are mounted to the drive shaft assembly on both ends of the stator. One of the brake pads is axially moveable relative to the shaft and is controlled by the camming mechanism and thereby moved into and away from the corresponding braking surface of the stator. The other pad is fixed to the brake shaft assembly which has limited axial float relative to the stator. Upon braking action of the cam mechanism, the one pad is cammed into the corresponding braking surface of the stator and that action pulls the shaft through the stator opening to affect equal braking action of both pads against the two end surfaces of the stator. The stator is in effect an extension of the drum in that heat generated by the pad acting against the end surface is conducted through the stator material to the drums outer surface.

Bearings are provided on the drive shaft assembly to maintain centering of the shaft.

Other advantages will become apparent upon review of the detailed description that follows wherein reference is made to the accompanying drawings.

DETAILED DESCRIPTION OF THE PREFERRED EMBODIMENT

Figure 1:
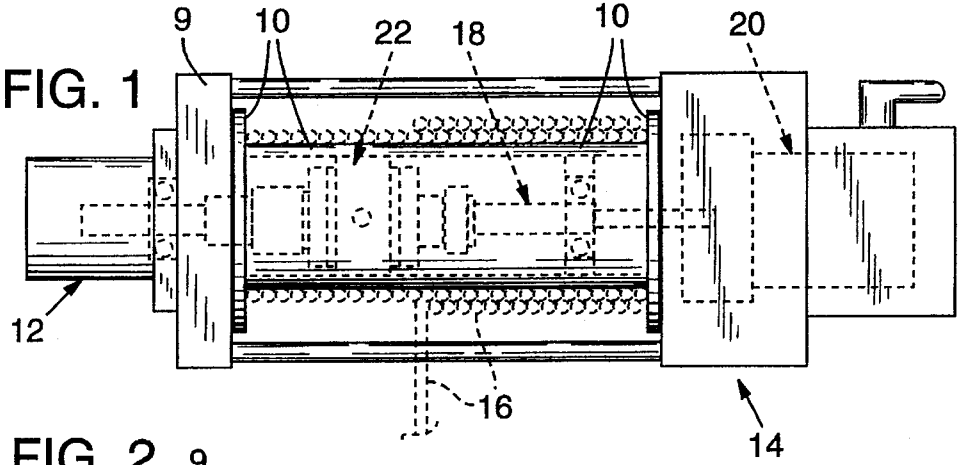
FIG. 1 illustrates a winch of the present invention wherein the internal components are shown as dash lines.
Figure 2:
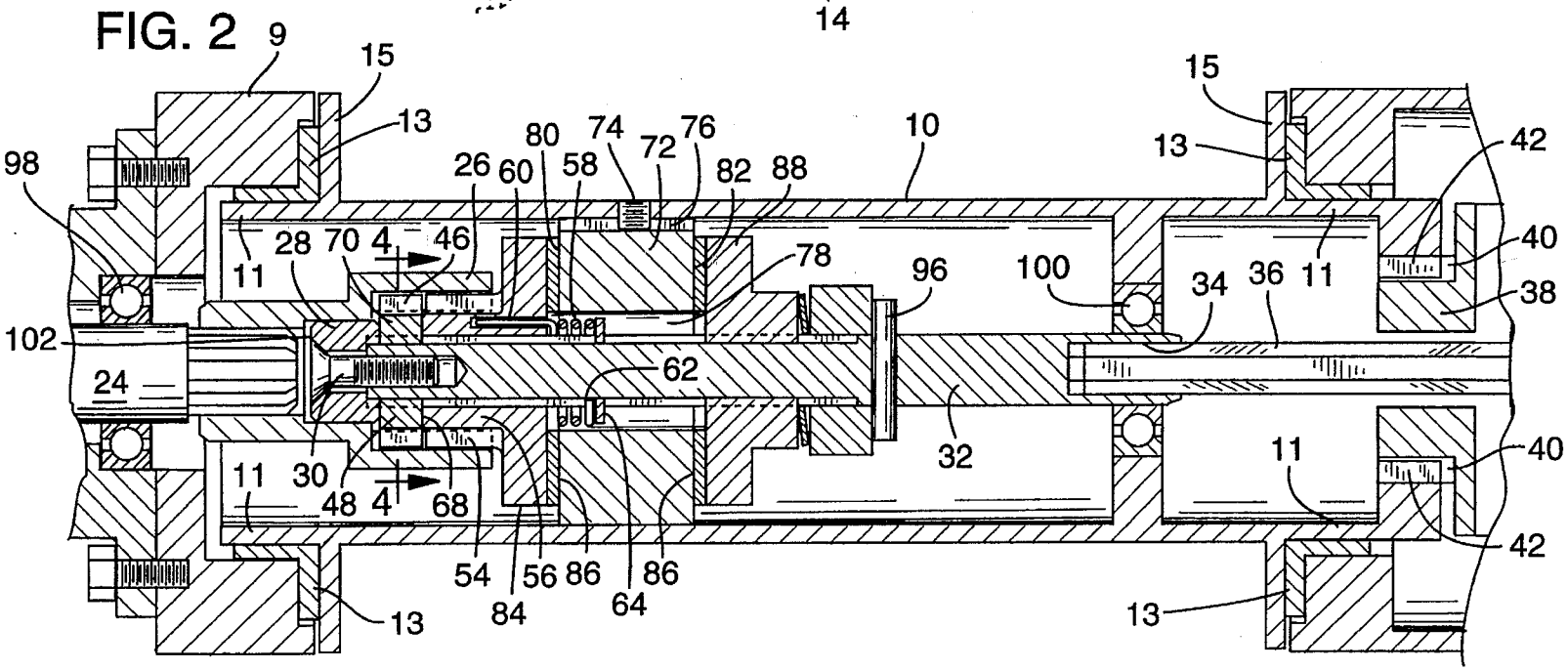
FIG. 2 is an enlarged partial sectional view of the winch of FIG. 1 illustrating the internal components.

With reference to FIGS. 1 and 2, the illustrated winch is designed, e.g., to be mounted on a vehicle bumper or on the bed of a tow truck. Basically the winch includes a cable drum 10 that is supported in the winch housing at its ends by bushings 13 for axial rotation relative to the stationary housing 9. A cable 16 wound on the drum 10 (and confined by drum flanges 15) is either wound onto or off of the drum with winding or unwinding rotation of the drum. Housing end 12 houses a motor that turns a shaft assembly 18 that extends through the center of the drum 10 and engages a planetary gear assembly 20 contained in housing end 14. The planetary gear assembly 20 is engaged with the cable drum 10. Thus the motor rotatively drives the shaft assembly 18 which rotatively drives the planetary gear assembly 20. The function of the planetary gear assembly is to reduce the rate of rotation so that the drum 10 is rotated by the planetary gear assembly at a rate that is a fraction of the rotation of the shaft assembly 18. Such gear reduction multiplies the torque produced by the motor as transmitted to the drums.

A brake mechanism 22 is mounted to the shaft assembly 18. The brake mechanism 22 functions to lock the shaft assembly 18 to the drum 10. The planetary gear assembly 20 is thus unable to generate the rotational difference between the shaft assembly 18 and the drum 10. The drum, the shaft and the winch housing are thus interlocked and rotation of the shaft and the winch is thereby stopped or braked.

Figure 3:
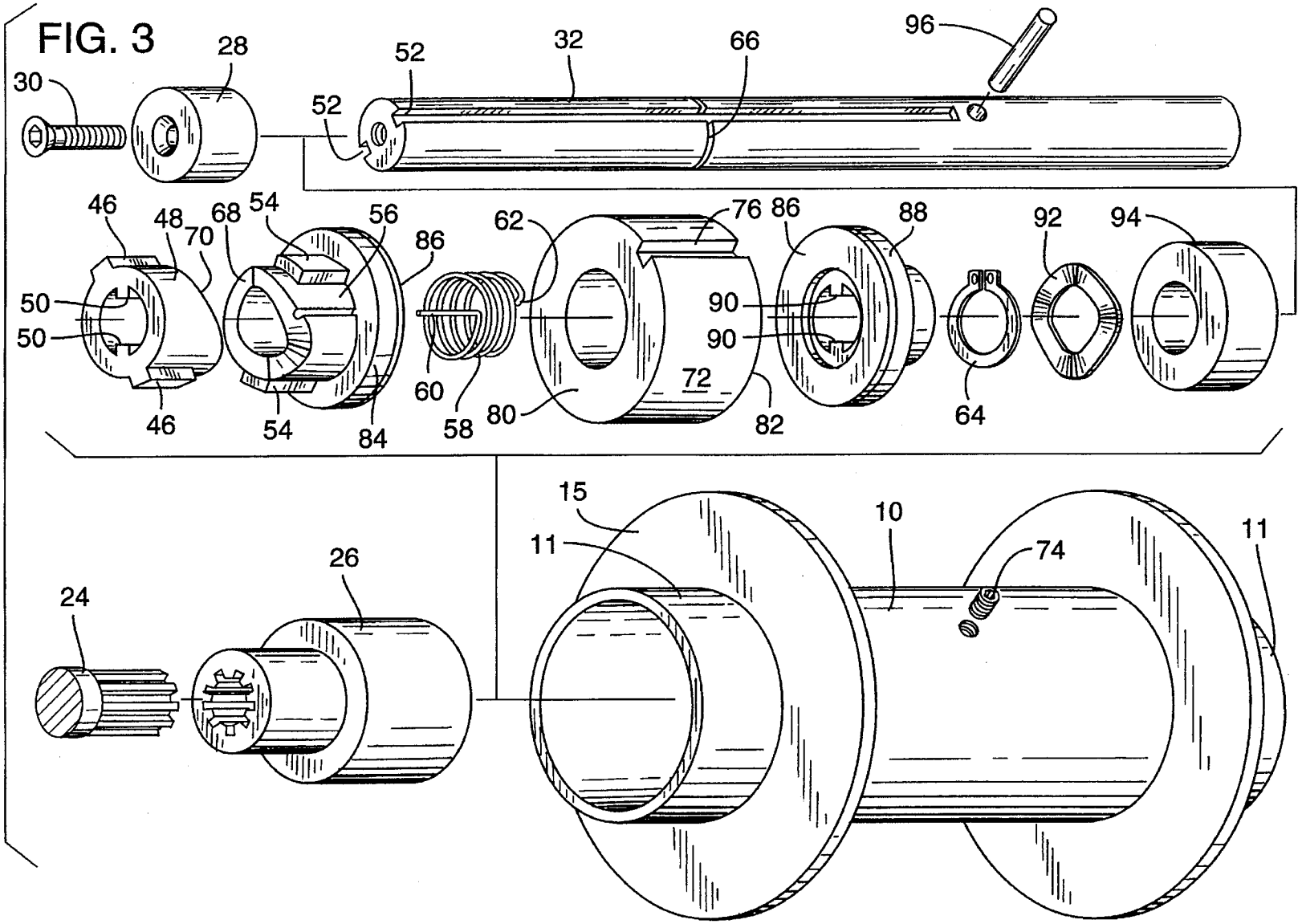
FIG. 3 is an exploded perspective view of the components of FIG. 2.

Reference is now made to FIGS. 2 and 3 for explanation of the shaft assembly 18. The motor in housing end 12 turns the motor drive shaft 24 in either a cable winding or unwinding direction (clockwise or counterclockwise). A driver 26 is spline fit to the drive shaft 24. A bushing 28 is seated in the driver 26 and is fastened by screw 30 to brake shaft 32 (sometimes referred to as a shaft extender). The bushing 28 permits relative rotation as between the brake shaft 32 and the driver 26. Coupling elements which will be later explained, couple the driver 26 to the brake shaft 32. The brake shaft 32, at its opposite end, has a female hexagonal shaped pocket 34 (FIG. 2) that receives the hexagonal shaped coupling shaft 36 that couples the brake shaft 32 to the planetary gear assembly (not shown but see the '646 patent).

The planetary gear assembly includes the partially illustrated gear member 38 (FIG. 2) which includes gear teeth 40 that engages gear teeth 42 on the drum end 11. As explained above, the planetary gear assembly reduces the rotation of the coupling shaft 36 so that drum 10 is rotated by the shaft assembly at a fraction of the rate of rotation of the shaft assembly.

Figure 4:
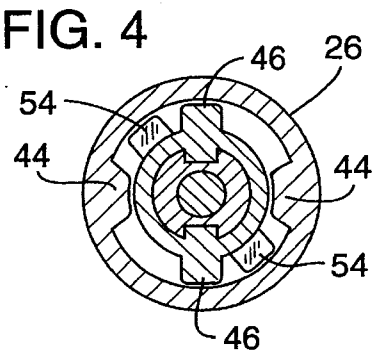
FIG. 4 is a section view as taken on section lines 4—4 of FIG.

With reference also to FIG. 4, the driver 26 drives shaft assembly 18 by inner lug portions 44 which become engaged with lug portions 46 on follower 48. Follower 48 is keyed to the brake shaft 32 by protrusions 50 seated in opposed grooves 52 provided along the length of the brake shaft 32. Thus the driver 26 may rotate either clockwise or counterclockwise for a partial rotation without rotating the shaft assembly 18 but only until the lugs 44 engage lugs 46 on the follower 48. Cam actuator lugs 54 are also illustrated in FIG. 4 and the cam actuator mechanism will now be explained.

Mounted to the brake shaft 32 inboard of the follower 48 is a cam actuator 56. A spring 58 is coiled and heat treated to resistively permit compression and coiling. One end 60 of spring 58 is protruded into an aperture in the inboard end of cam actuator 56 (see FIG. 2) and the other end 62 is protruded into the groove 52 of the brake shaft 32. A snap ring 64 is seated in retaining or a circular groove 66 in the brake shaft 32 and prevents inboard movement of the spring 58.

The cam actuator 56 and cam follower 48 have abutting end faces 68, 70 respectively that are cam shaped as illustrated in FIG. 3. As will be apparent, follower 48 is keyed to brake shaft 32 as is end 62 of spring 58. The spring 58 is preloaded to urge rotation of actuator 56 whereby cam face 68 is urged to ramp up cam face 70 which separates the follower 48 and actuator 56. With reference to FIG. 4, when driver 26 is rotated counter clockwise, lugs 44 initially engage follower lugs 46 which urges lugs 46 towards actuator lugs 54. This action produces relative rotation of the actuator and follower to allow nesting of the cam faces 68, 70 in opposition to the urging of spring 58. Opposite rotation of the driver 26 produces the same result as in this latter event the driver lugs 44 first engage actuator lugs 54 to produce the same relative rotation of the actuator and follower and again allowing nesting of cam faces 68, 70. The cam actuation in the static mode (i.e., driver 26 non-rotating) is what produces the braking action which will now be explained.

A cylindrical stator 72 is fixedly secured to the inner wall of the drum 10. A lock screw 74 is projected into slot 76 in the stator 72. However, heat will cause expansion of the stator 72 and produce a tight fit of the stator to the inner wall of the drum. The stator has a center bore 78 that allows passage therethrough of the shaft assembly. Spring 58 and retaining ring 64 are also located in the center bore 78. Cylindrical faces 80, 82 at each end provide braking surfaces. As illustrated, the cam actuator 56 is provided with a brake pad portion 84 having a facing material 86 that frictionally engages cylindrical face 80 of the stator 72. Mounted on the brake shaft 32 on the other side 82 of the stator is a brake pad 88 also provided with a facing material 86 adapted to frictionally engage the cylindrical surface 82 of the stator 72. The pad 88 has protrusion 90 that fits in the grooves 52 of brake shaft 32. A disc spring washer such as a Belleville washer 92 allows some flexure of the pad 88, i.e., limited axial movement as permitted by collapsing the washer 92. A spacer ring 94 and pin 96 prevents sliding of the washer 92 on the brake shaft. The Belleville washer dampens vibration and/or chatter.

Maintaining a centered position for the rotating shaft assembly 18 (including drive shaft 24, brake shaft 32 and coupling shaft 36) is achieved by bearing 98 at the motor end and bearing 100 at the coupling shaft end. It will be apparent that brake shaft 32 is allowed to float or slide axially relative to the stator 72 as provided by the spacing 102 at the end of bushing 28. The purpose of this "float" will be apparent from the operation section which follows.

Operation

As previously explained, the action of the cam actuator 56, cam follower 48 and spring 58 is to urge separation of the cam actuator from the follower. This action urges pad 84 toward stator face 80. Because the brake shaft 32 floats, the shaft assembly will be pulled through the opening to draw the pad 88 against stator face 82. The facing material 86 when applied to the stator end faces produces the desired braking action, i.e., the shaft assembly 18 is locked to the drum 10 and the planetary gear assembly cannot produce the differential rotation and thus interlocks the entire assembly to the winch housing.

Regardless of which direction the drive shaft 24 is rotated the relative rotation of lugs 46, 54 is the same to allow nesting of the cam faces and release of the brake.

The arrangement of stator 72 and pads 84, 88 allows axial brake pad action in the manner of a disk brake. The stator 72 is a highly heat conductive metal material that conducts heat from the faces 80, 82 to the drum 10, through the drum wall and thus to the atmosphere. The disc spring washer, e.g., the Belleville washer, cushions the braking action of the pads to avoid brake chatter and the bearings 98, 100 assure centered alignment of the shaft assembly 18 to provide for smooth operation of a heavy duty winch that alleviates overheating.

Those skilled in the art will become aware of numerous modifications and variations without departing from the inventive concept as described and such variations and modifications are encompassed by the claims as appended hereto.

We claim:

1. A winch comprising:

a housing;

a cable drum assembly having opposed ends and a cylindrical exterior surface, said drum assembly rotatably mounted to the housing and a cable mounted to the exterior surface of the drum to be wound onto and off of the drum upon alternate rotation of the drum;

a motor having a drive shaft mounted to the housing at one end of the drum, a brake shaft coupled to the motor drive shaft and extended through the center of the drum toward the opposite end of the drum, a gear reducer mechanism at said opposite end engaged with the brake shaft, said gear reducer mechanism engaged with the drum and configured to reduce the rotational affect of the drive shaft as applied to the drum;

a brake surface on said cable drum assembly, a movable braking member provided on said brake shaft and rotatable therewith and movable between engaged and disengaged frictional braking engagement with said brake surface of the drum assembly whereby, when engaged, the relative rotative movement between the brake shaft and drum is resisted; and a stator fixedly mounted to the drum interior comprising a heat conductive cylinder having a cylindrical outer surface constantly in surface-to-surface contact with a cylindrical inner surface of the drum, and having opposed end faces, one of which is disposed in a plane normal to the axis of the drum, said one end surface providing the brake surface whereby axial movement of the braking member produces surface-to-surface braking engagement in the manner of a disc brake, and said cylinder further having a center opening and a brake shaft extended through said center opening.

2. A winch as defined in claim 1 wherein said braking member comprises a pair of braking pads, one on each side of the cylinder, both end faces of said cylinder providing brake surfaces engageable by said braking pads.

3. A winch as defined in claim 2 including a cam mechanism actuating said braking member including a cam actuator and a cam follower having mated cam surfaces whereby alternate relative rotation allows axial nesting in one direction and forces axial separation thereof in the other direction, one of said braking pads carried by one of said cam actuator and cam follower whereby axial separation thereof moves the one braking pad into braking engagement with the corresponding end face of said cylinder.

4. A winch as defined in claim 3 wherein said cam mechanism includes a biasing member rotatively biasing the actuator and follower to the axial separation condition, and a driver coupling the motor drive shaft to the cam actuator and cam follower whereby rotation of the drive in either rotative direction counters the biasing action of the biasing member to permit axial nesting and disengagement of the braking member.

5. A winch as defined in claim 4 wherein the brake shaft has limited sliding movement relative to the stator and whereby upon movement of said one braking pad against the corresponding end face of the stator produces relative sliding of the brake shaft and the other brake pad thereon to move said other brake pad into braking engagement with said other end face of the stator.

6. A winch as defined in claim 1 wherein the motor drive shaft, brake shaft and gear reducer mechanism in part provides a shaft assembly rotated in unison by said motor, and support bearings provided on each end of the shaft assembly to maintain centering of said shaft assembly within said drum assembly.

* * * * *